US008376324B2

(12) United States Patent
Zhang et al.

(10) Patent No.: US 8,376,324 B2
(45) Date of Patent: Feb. 19, 2013

(54) READJUSTMENT-PREVENTING CARBURETOR AND A METHOD FOR PREVENTING THE CARBURETOR FROM BEING READJUSTED

(75) Inventors: Chaojian Zhang, Yancheng (CN); Junxing Wang, Yancheng (CN); Ming Bian, Yancheng (CN); Chengcun Wang, Yancheng (CN); Lu Shi, Yancheng (CN)

(73) Assignee: Jiangsu Jianghuai Engine Co., Ltd., Jiangsu Province (CN)

( * ) Notice: Subject to any disclaimer, the term of this patent is extended or adjusted under 35 U.S.C. 154(b) by 662 days.

(21) Appl. No.: 11/792,608

(22) PCT Filed: Jan. 9, 2006

(86) PCT No.: PCT/CN2006/000023

§ 371 (c)(1),
(2), (4) Date: Feb. 16, 2010

(87) PCT Pub. No.: WO2007/079608

PCT Pub. Date: Jul. 19, 2007

(65) Prior Publication Data

US 2011/0042837 A1 Feb. 24, 2011

(51) Int. Cl.
*F02M 3/08* (2006.01)

(52) U.S. Cl. ..... 261/71; 261/DIG. 38; 261/DIG. 84

(58) Field of Classification Search ..... 261/71, 261/DIG. 38, DIG. 84; 137/382, 382.5, 384, 137/385

See application file for complete search history.

(56) References Cited

U.S. PATENT DOCUMENTS 3,321,195 A * 5/1967 Korte ..... 261/41.5
3,414,244 A * 12/1968 Patterson, Jr. ..... 261/41.5

(Continued)

FOREIGN PATENT DOCUMENTS

CN 2661945 Y 12/2004
CN 2737969 Y 11/2005

(Continued)

OTHER PUBLICATIONS

International Search Report for corresponding PCT application serial No. PCT/CN2006/000023 (two pages) Chinese, Jun. 22, 2006.

(Continued)

*Primary Examiner* — Richard L Chiesa
(74) *Attorney, Agent, or Firm* — Morris Manning & Martin LLP; Tim Tingkang Xia, Esq.

(57) ABSTRACT

The present invention discloses a readjustment-preventing carburetor and a method for preventing the carburetor from being readjusted. The carburetor includes an idle adjusting screw having a concave neck, an idle port and a screw hole communicating with the idle port. The idle adjusting screw is joined with the screw hole as a whole after being adjusted to a certain position, and any further adjustment will cause the concave neck to be broken off to prevent the idle adjusting screw of the carburetor from being readjusted. Additionally, the idle adjusting screw is joined with the screw hole by bonding or welding, thereby fundamentally preventing anyone from readjusting the idle adjusting screw of the carburetor and ensuring the discharge of the gasoline engine always in conformity with the requirements of environmental protection. The carburetor and the method of the present invention have the characteristics of simple process and structure, safety use and reliability.

10 Claims, 2 Drawing Sheets

U.S. PATENT DOCUMENTS

| | | | | | |
|---|---|---|---|---|---|
| 3,454,264 | A | * | 7/1969 | Sarto | 261/23.2 |
| 4,273,730 | A | * | 6/1981 | Byrnes, Jr. | 261/41.5 |
| 4,308,220 | A | * | 12/1981 | Tateno | 261/41.5 |
| 4,331,616 | A | * | 5/1982 | Kato et al. | 261/50.2 |
| 4,470,769 | A | * | 9/1984 | Owens | 417/313 |
| 6,003,845 | A | * | 12/1999 | Kus | 261/39.4 |
| 6,302,383 | B1 | * | 10/2001 | Scarr | 261/71 |
| 6,302,384 | B1 | * | 10/2001 | Douyama | 261/71 |
| 6,402,125 | B1 | * | 6/2002 | Burns et al. | 261/71 |
| 2001/0026025 | A1 | * | 10/2001 | Nagata et al. | 261/71 |
| 2002/0070466 | A1 | * | 6/2002 | Burns et al. | 261/71 |

FOREIGN PATENT DOCUMENTS

| | | | | | |
|---|---|---|---|---|---|
| GB | 1369177 | A | | 10/1974 | |
| JP | 55-109748 | A | * | 8/1980 | 261/DIG. 84 |

OTHER PUBLICATIONS

English translation of International Search Report for corresponding PCT application serial No. PCT/CN2006/000023 (two pages), Jun. 22, 2006.

* cited by examiner

READJUSTMENT-PREVENTING CARBURETOR AND A METHOD FOR PREVENTING THE CARBURETOR FROM BEING READJUSTED

RELATED APPLICATION

This application is a nationalization under 35 U.S.C. 371 of PCT/CN2006/000023, filed Jan. 9, 2006; which application is incorporated herein by reference and made a part hereof.

TECHNICAL FIELD

The present invention relates to an atomization device of a fuel supply system of a gasoline engine, and particularly to a gasoline engine carburetor capable of preventing its idle adjusting device from being readjusted and a method for preventing the carburetor from being readjusted.

BACKGROUND ART

A carburetor of a gasoline engine is mainly constituted by two parts of a mixing system and a float system. The float system is mainly constituted by a float chamber body, a float assembly, a float needle valve, a float chamber cap and so on. The mixing system is mainly constituted by a main nozzle, a venturi body, a main jet, a venturi, a throttle, a choke, an idle adjusting screw and so on. Moreover, the carburetor is further provided with an idling speed oil supply device: As the engine idles at low speed, the throttle is almost completely closed. However, the suction force is very large behind the throttle where an idle port communicates with the venturi with the oil ejection quantity of the idle port being controlled by the idle adjusting screw. Before leaving the factory, the idle adjusting screw has been adjusted to a proper position, thus ensures the normal operation of the gasoline engine under idle operating conditions and limits the exhaust-gas discharge of the gasoline engine to a minimum, thereby meets the requirements of the environmental protection. The idle screw will not change its position by itself under the spring force of a retaining spring. After the carburetor is obtained by the user, there is usually no need to readjust the idle adjusting screw. However, there exists the problem that it is unable to ensure the user not to readjust the idle adjusting screw. To prevent the user from adjusting the idle adjusting screw by himself during the using process which affects the discharge of the gasoline engine, it is desirable to limit the readjustment applied on the idle adjusting screw by the user.

CONTENTS OF THE INVENTION

The technical problems the present invention aims to solve is to provide a method for preventing a carburetor from being readjusted and a adjustment-preventing carburetor, thereby fundamentally prevent the exhaust-gas discharge of the gasoline engine from being affected due to the readjustment applied on the idle adjusting device of the carburetor by the user.

To solve the above-mentioned technical problems, the present invention provides a carburetor, comprising an idle adjusting screw, an idle port and a screw hole communicating with the idle port, wherein said idle adjusting screw is consolidated with said screw hole as a whole after being adjusted to a certain position, so as to prevent the idle adjusting screw of the carburetor from being readjusted. Said consolidation of the present invention is to integrate the idle adjusting screw without using other parts directly with said screw hole as a whole which cannot be disassembled.

Said carburetor comprises a float system comprising a float chamber and a float, and a mixing system comprising a venturi body, a venturi, an idle adjusting screw, an idle port and a screw hole, wherein the venturi communicates with the idle port, and said idle port communicates with the screw hole, wherein said idle adjusting screw is consolidated with the screw hole on the venturi body as a whole, so as to prevent the idle adjusting screw of the carburetor from being readjusted.

Further, the consolidation of said idle adjusting screw with said screw hole is bonding or welding.

Further, said idle adjusting screw is bonded at its thread body with said screw hole.

Still further, a concave neck is provided between the screw head and the thread of said idle adjusting screw and the concave neck will break off when the screw head is forcibly rotated after said idle adjusting screw is consolidated with said screw hole as a whole.

An alternative is to break off the portion of the idle adjusting screw emerging from the screw hole after said idle adjusting screw is consolidated with the screw hole as a whole.

The alternatives further comprise an assembly groove provided on the outer surface of the screw head, wherein the assembly groove on the outer surface of the screw head is filled with frozen metal-bonding glue or metal materials and then consolidated with the same as a whole after said idle adjusting screw is adjusted to a certain position, so as to prevent the readjustment through the assembly groove on said idle adjusting screw.

The present invention further provides a method for preventing the user from readjusting an idle adjusting screw of a carburetor, in which said idle adjusting screw is mounted in a screw hole communicating with an idle port, wherein the method comprises the step of consolidating said idle adjusting screw with said screw hole as a whole after adjusting it to a certain position during manufacturing process, so as to prevent the carburetor from being readjusted, and thereby ensure the discharge of the gasoline engine always in conformity with the requirements of environmental protection.

Further, said idle adjusting screw is consolidated with said screw hole as a whole by means of bonding or welding.

Still further, said idle adjusting screw is bonded at its thread body with said screw hole.

Further, the method comprises the steps of producing between the screw head and the thread of said idle adjusting screw a concave neck which will break off when the screw head is forcibly rotated after said idle adjusting screw is consolidated with said screw hole as a whole.

Another alternative is breaking off the portion of said idle adjusting screw emerging from said screw hole after said idle adjusting screw is consolidated with the screw hole as a whole.

The alternatives further comprise providing an assembly groove on the outer surface of the screw head, filling the assembly groove on the outer surface of the screw head with frozen metal-bonding glue or metal materials and consolidating the glue or metal materials with the assembly groove as a whole after said idle adjusting screw is adjusted to a certain position, so as to prevent the readjustment through the assembly groove on said idle adjusting screw.

DESCRIPTION OF THE FIGURES

The present invention will be described in further detail with reference to the figures and the embodiments.

Wherein, 1 screw head, 2 thread body, 3 venturi body, 4 screw hole, 5 concave neck, 6 idle adjusting screw, 7 idle port, 8 throttle, 9 venturi, 10 float chamber, 11 mixing chamber, 12 choke, 13 assembling groove.

EMBODIMENT

Figure 1:
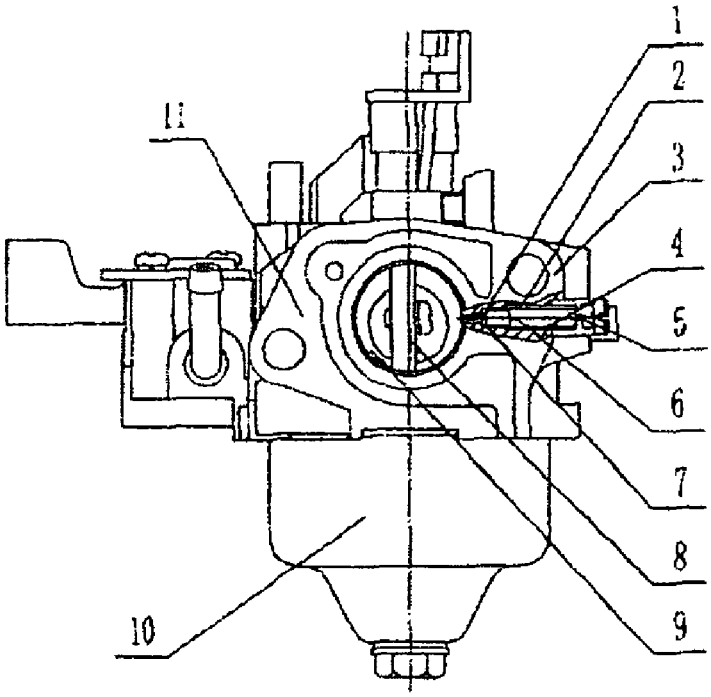
FIG. 1 is a structurally schematic view of a carburetor of the present invention.
Figure 2:
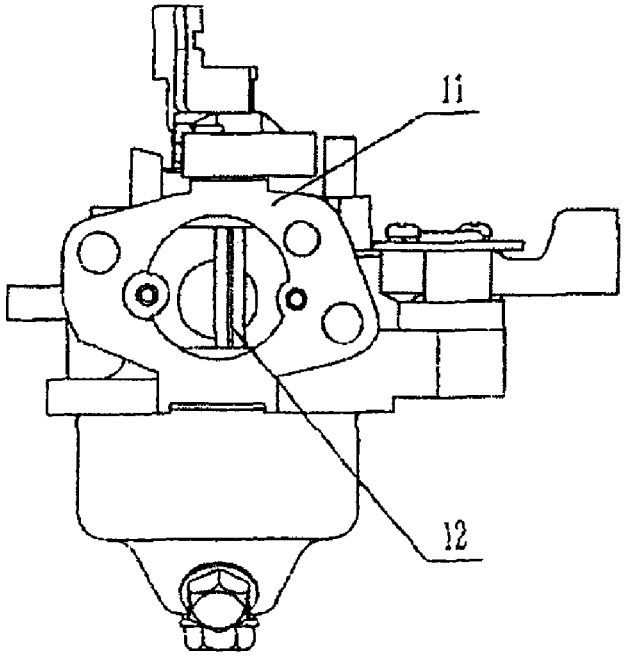
FIG. 2 is a rear view of the carburetor shown in FIG. 1.

In FIG. 1, the carburetor is mainly constituted by two parts of a mixing system and a float system. The mixing system is located above the float system. The float system is mainly constituted by a float chamber body, a float assembly, a float needle valve, a float chamber cap and so on, being used to store gasoline and always automatically maintain oil-quantity of the carburetor at a degree meeting the specified requirements. The mixing system is mainly constituted by a venturi body 3, a venturi 9, a main nozzle, a main jet, a throttle 8, a choke 12, and an idle adjusting screw 6 and so on. The throttle 8 and the choke 12 are provided at the two ends inside the venturi 9 respectively. The main nozzle is located at the middle inside the venturi 9. The working process of the mixing system is as follows: as the gasoline engine inlets the air, i.e., as it works after the gasoline enters into the main nozzle from the float chamber 10 through the main jet, the air in the venturi 9 above the main nozzle flows rapidly, which creates suction force under low pressure of the vacuum, such that the gasoline is atomized immediately after being suctioned out of the main nozzle, and then enters into the cylinder after mixing with air. The throttle 8 is used to control the quantity of the mixture entering into the cylinder. If the opening of the throttle 8 is small, the mixture entering into the cylinder reduces, and the power of the engine decreases accordingly, otherwise the power of the engine increases accordingly. The choke 12 is used to control the quantity of the air entering into the venturi 9, usually used at the startup of the engine. The carburetor is further provided with an idling speed oil supply device which is used to maintain the lowest steady rotating speed (idling speed) as the engine idles. When the engine idles at low speed, the throttle 8 is almost completely closed, such that the air at the venturi 9 flows very slowly and the suction force is too small to suction the gasoline out of the main nozzle. However, the suction force behind the throttle 8 where the idle port 7 is located is very large during the intake stoke because the throttle 8 is almost closed. The idle port communicates with the float chamber through an idling oil passage and an idling oil jet.

An idle air jet communicates with the intake pipe of the carburetor. Thus, the gasoline in the float chamber is suctioned out via the idle oil jet, afterwards mixes firstly with a small amount of air that is suctioned from the idle air jet, then ejects out of the idle port 7, and is blown over rapidly by a high speed gas flow passing through a streit gap at the edge of the throttle 8, thereby forms good mixture. The ejected oil-quantity from the idle port 7 is controlled by adjusting the volume of the space between the screw head 1 of the idle adjusting screw 6 and the idle port 7.

Figure 3:
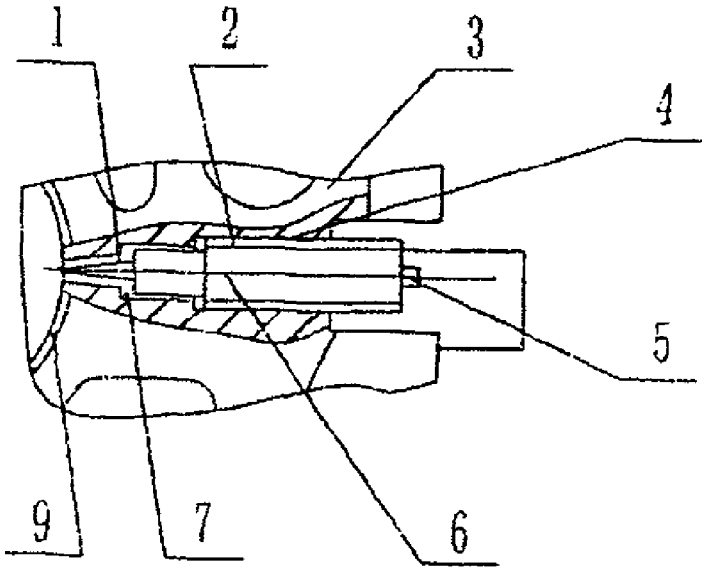
FIG. 3 is a structurally schematic view of the idle adjusting screw of the present invention, with the cancove neck has broken off.
Figure 4:
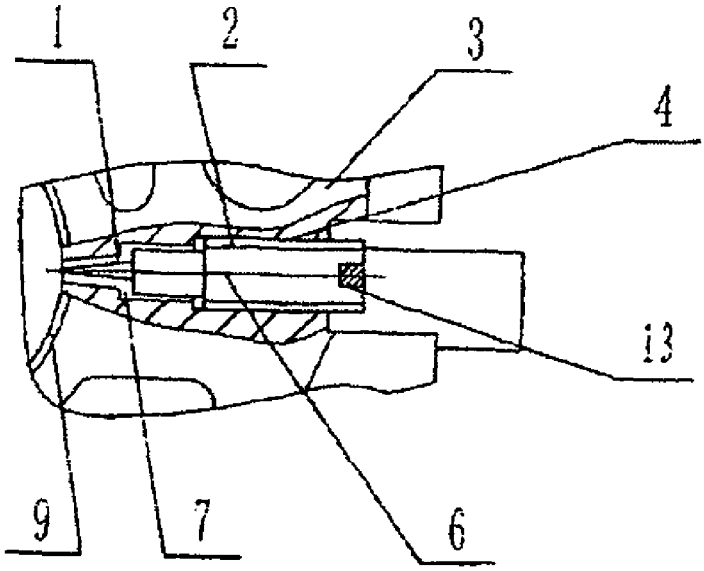
FIG. 4 is an assembling structure view of the idle adjusting screw of the present invention, with the idle adjusting screw being a flat head screw.

To prevent the user from adjusting the idle adjusting screw 6 by himself, when securing the idle adjusting screw 6, the metal-bonding glue can be applied onto the thread body 2 of the screw, then it will consolidate rapidly after the idle adjusting screw 6 is adjusted to a proper position under the idle state, such that the idle adjusting screw 6 is consolidated with the screw hole 4 on the venturi body 3 as a whole; or welding and the like can be adopted to consolidate the idle adjusting screw 6 with the screw hole 4 on the venturi body 3 as a whole. Hence, the user is unable to adjust the idle adjusting screw 6 because the idle adjusting screw 6 is consolidated with the screw hole 4 as a whole which cannot be disassembled. The idle adjusting screw 6 may further be provided with a concave neck 5. After obtaining a qualified gasoline engine, if the user wants to take adjustment by himself, the concave neck 5 will break off when the screw head of the idle adjusting screw is forcibly rotated because of the consolidation of the idle adjusting screw 6 and the screw hole 4 on the venturi body 3, as shown in FIG. 3. Further adopted is to break off the portion of the idle adjusting screw 6 emerging from a mounting hole to prevent the readjustment applied on the idle adjustment screw; or to fill an assembly groove on the outer surface of the screw head of the idle adjusting screw, such as the assembly groove 13 of the flat head screw, with frozen metal-bonding glue or metal materials, as shown in FIG. 4, such that the user cannot adjust the idle adjusting screw 6 with tools through the assembly groove 13, thereby preventing the user from adjusting the idle adjusting screw 6 by himself and ensuring the discharge of the gasoline engine always in conformity with the requirements of environmental protection.

Compared with the prior art, the carburetor and the method of the present invention have the characteristics of simple process and structure, safety use and reliability, and thus can be used for the gasoline engines of all motor vehicles.

What is claimed is:

1. A carburetor, comprising, (a) a float system having a float chamber and a float; and (b) a mixing system having a venturi body and a venturi, wherein the venturi communicates with an idle port, a screw hole communicates with the idle port on the venturi body, and an idle adjusting screw having a screw head, a thread body and a concave neck is installed in the screw hole on the venturi body, wherein the idle adjusting screw is joined to the screw hole as a unitary body after the idle adjusting screw is adjusted to a predetermined position, such that a further adjustment of the idle adjusting screw causes the concave neck of the idle adjusting screw to be broken off, thereby preventing the idle adjusting screw of the carburetor from being further adjusted.

2. The carburetor according to claim 1, wherein the idle adjusting screw is joined to the screw hole by bonding or welding.

3. The carburetor according to claim 2, wherein the idle adjusting screw is joined at the idle adjusting screw thread body to the screw hole.

4. The carburetor according to claim 1, wherein an assembly groove is provided on an outer surface of the screw head, and the assembly groove on the outer surface of the screw head is filled with frozen metal-bonding glue or metal materials and joined with the screw hole as a unitary body after said idle adjusting screw is adjusted to a predetermined position, so as to prevent the readjustment through the assembly groove on the idle adjusting screw.

5. A method for preventing a user from readjusting an idle adjusting screw of a carburetor having a float system with a float chamber and a float, and a mixing system with a venturi body and a venturi in which the idle adjusting screw having a screw head, a thread body and a concave neck is installed in a screw hole communicating with an idle port, the method comprising the step of:

joining the idle adjusting screw with the screw hole as a unitary body after the idle adjusting screw is adjusted to a predetermined position during manufacturing process such that a further adjustment of the idle adjusting screw causes the concave neck of the idle adjusting screw to be broken off, thereby preventing the idle adjusting screw of the carburetor from being further adjusted.

6. The method according to claim 5, wherein the idle adjusting screw is joined at its thread body to the screw hole by bonding or welding.

7. The method according to claim 5, wherein the method further comprises the steps of:

(a) providing an assembly groove on an outer surface of the screw head;

(b) filling the assembly groove on the outer surface of the screw head with frozen metal-bonding glue or metal materials; and (c) joining the glue or metal materials with the assembly groove as a whole after the idle adjusting screw is adjusted to a predetermined position, thereby preventing readjustment through the assembly groove on the idle adjusting screw.

8. A carburetor, comprising:

(a) a float system having a float chamber and a float; and (b) a mixing system having a venturi body and a venturi, wherein the venturi communicates with an idle port, an aperture communicates with the idle port on the venturi body, and an idle adjusting screw having a screw head, a thread body and a concave neck is installed in the aperture on the venturi body, wherein the idle adjusting screw is joined to the aperture as a unitary body after the idle adjusting screw is adjusted to a predetermined position, such that a further adjustment of the idle adjusting screw causes the concave neck of the idle adjusting screw to be broken off, thereby preventing the idle adjusting screw of the carburetor from being further adjusted.

9. The carburetor according to claim 8, wherein the idle adjusting screw is joined to the aperture by bonding or welding.

10. The carburetor according to claim 9, wherein the idle adjusting screw is joined at the idle adjusting screw thread body to the aperture.

* * * * *